US008459495B2

(12) United States Patent
Koenig et al.

(10) Patent No.: US 8,459,495 B2
(45) Date of Patent: Jun. 11, 2013

(54) PORTABLE CONTAINER

(75) Inventors: Andreas Koenig, Leipheim (DE); Timo Kuhls, Stuttgart (DE); Raimund Schäffer, Ulm (DE); Lutz Wolle, Burlafingen (DE)

(73) Assignee: TTS Tooltechnic Systems AG & Co. KG, Wendlingen, DE (US)

( * ) Notice: Subject to any disclaimer, the term of this patent is extended or adjusted under 35 U.S.C. 154(b) by 202 days.

(21) Appl. No.: 13/119,662

(22) PCT Filed: Jun. 29, 2009

(86) PCT No.: PCT/EP2009/004669
§ 371 (c)(1),
(2), (4) Date: Mar. 17, 2011

(87) PCT Pub. No.: WO2011/000386
PCT Pub. Date: Jan. 6, 2011

(65) Prior Publication Data

US 2011/0168729 A1 Jul. 14, 2011

(51) Int. Cl.
*B65D 25/28* (2006.01)
*B65D 21/00* (2006.01)

(52) U.S. Cl.
USPC ..... 220/761; 220/763; 220/770

(58) Field of Classification Search
USPC .... 220/761, 763, 764, 768, 770, 771; 16/408, 16/409, 425
See application file for complete search history.

(56) References Cited

U.S. PATENT DOCUMENTS

| | | | | |
|---|---|---|---|---|
| 2,634,020 | A | 4/1953 | Bartholomew | |
| 3,182,856 | A | 5/1965 | Goltz | |
| 3,387,732 | A * | 6/1968 | Jellies | 215/375 |
| 3,581,928 | A * | 6/1971 | St. Amand | 215/375 |
| 4,351,448 | A | 9/1982 | Ingersoll et al. | |
| 5,353,948 | A | 10/1994 | Lanoue et al. | |
| 5,469,961 | A | 11/1995 | Chang | |
| 5,606,820 | A | 3/1997 | Suddeth | |
| 5,699,925 | A | 12/1997 | Petruzzi | |
| 5,755,180 | A | 5/1998 | Smith | |
| 6,761,266 | B2 | 7/2004 | Popish | |
| 6,959,507 | B2 | 11/2005 | Bazany et al. | |
| 7,246,718 | B2 | 7/2007 | Einav et al. | |
| 2003/0155267 | A1 | 8/2003 | Mercier et al. | |
| 2005/0224494 | A1 | 10/2005 | Heinrichs et al. | |
| 2008/0308641 | A1 | 12/2008 | Finn | |

(Continued)

FOREIGN PATENT DOCUMENTS

| | | |
|---|---|---|
| BE | 378243 | 1/1981 |
| DE | 4201264 | 7/1993 |

(Continued)

*Primary Examiner* — Harry Grosso
(74) *Attorney, Agent, or Firm* — Hoffmann & Baron, LLP

(57) ABSTRACT

A portable container (1) is proposed, with a container body (2) which has a top (4), facing upwards in a first container alignment. A movable carrying handle (5) provided on the container body (2) may be moved from a not-in-use position close to the container body (2) into a position of use, so that it may be used to carry the container in the first container alignment. Also formed on the top (4) is an immovable additional carrying handle (6) formed by a side wall of a recess (38) which has an engaging recess (54) in which the fingers of one hand may engage in order to carry the container (1) in a second container alignment with its top (4) oriented to the side.

21 Claims, 4 Drawing Sheets

U.S. PATENT DOCUMENTS

Figure 1:
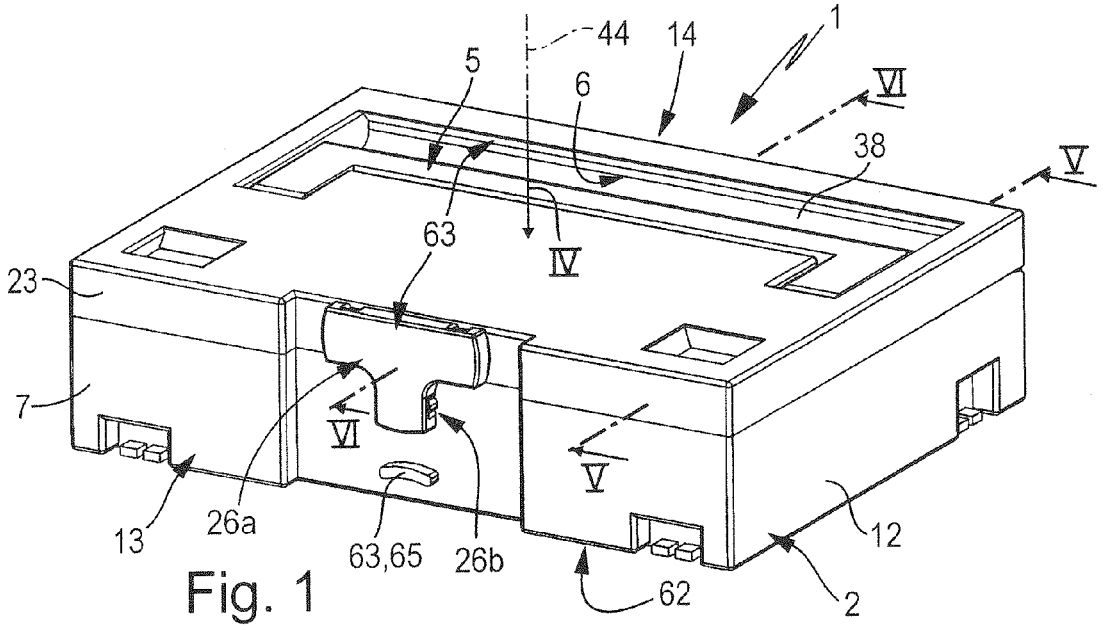

| | | | |
|---|---|---|---|
| 2009/0139892 | A1 | 6/2009 | Vovan et al. |
| 2009/0178989 | A1 | 7/2009 | Accuardi |
| 2009/0236255 | A1 | 9/2009 | Piacenza et al. |

FOREIGN PATENT DOCUMENTS

| | | |
|---|---|---|
| DE | 4409411 | 9/1995 |
| DE | 29922447 | 5/2000 |
| DE | 20104892 | 10/2001 |
| DE | 20112393 | 11/2001 |
| DE | 20119308 | 3/2002 |
| DE | 20319100 | 4/2004 |
| DE | 102007032382 | 1/2008 |
| EP | 0043540 | 1/1982 |
| EP | 0555533 | 8/1994 |
| EP | 0997234 | 5/2000 |
| EP | 1059240 | 12/2000 |
| EP | 1059240 | 2/2003 |
| EP | 1516703 | 3/2005 |
| EP | 1752262 | 2/2007 |
| EP | 2020188 | 2/2009 |

* cited by examiner

PORTABLE CONTAINER

The invention relates to a portable container with a container body and a movable carrying handle mounted on the container body, wherein the container body has a top which faces upwards on adoption of a first container alignment and on which it is provided with a recess bounded by a side wall, and wherein the movable carrying handle may be positioned in either a position of use extending upwards above the container body, on adopting the first container alignment, or in a not-in-use position closer to the container body relative to the former position.

A container of this kind known from EP 0 555 533 B1 has a container body consisting of a box- or bowl-shaped bottom part, and a lid mounted pivotably on the bottom part. In the usual container alignment, the lid is on top, so that it may be handled easily to gain access to a container interior bounded by the container body. A carrying handle provided on the lid on the top of the container body is used to transport the container, and may be swivelled either into a position of use extending upwards above the container body, or into a not-in-use position in which it comes to lie sunk in a recess of the lid.

Especially in the case of containers with a relatively large base, the carrying of the container using the carrying handle swivelled into the position of use is sometimes not ideal, since in this case the carrying handle generally provided in the centre of the top comes to lie at a relatively great distance from the body of the person carrying the container. In EP 1 059 240 B1 it has therefore already been suggested, in particular for containers with a relatively low overall height and with dimensions similar to those of a briefcase, to facilitate transport also in an upright second container alignment. For this purpose the movable carrying handle, on adopting a position swivelled on to the container body, may be pulled out into a further position of use positioned in front of a narrow side of the container body. This solution, which functions very well in principle, is however relatively costly to implement in practice.

The problem of the present invention is to propose measures to improve the convenience of carrying the container in a simple and cost-effective manner.

To solve this problem it is provided, in connection with the features described above, that a length section of the side wall of the recess formed on the top of the container body forms an immovable additional carrying handle usable as an alternative to the movable carrying handle, in that this length section has an engaging recess open towards the recess and in which the fingers of a hand may engage from below to carry the container, when the container body adopts a second container alignment with the top oriented sideways.

In this way it is possible for the container to be transported in one of two alternative container alignments. Here for gripping with one hand, either in the first container alignment the movable carrying handle is used, or in the second container alignment the immovable additional carrying handle is used. Especially containers with relatively low height compared with their length and width, somewhat like briefcases, may be transported comfortably held very close to the body using the additional carrying handle. The engaging recess ensures secure holding of the container without the risk of the hand gripping the additional carrying handle slipping away.

Advantageous developments of the invention are disclosed in the dependent claims.

The length section of the side wall of the recess formed on the top of the container body is expediently arranged off-centre on the top in such a way that the engaging recess faces towards the centre of the top. Consequently, on adopting the second container alignment, the additional carrying handle is located above the container centre, so that on gripping the additional carrying handle the container automatically assumes a stable position.

Expediently, the additional carrying handle has a linear longitudinal extent and is preferably so arranged that it extends parallel to the front or rear side wall of the container body.

The movable carrying handle could for example be mounted so as to slide or telescope on the container body. Regarded as especially expedient however is a design in which it is mounted pivotably on the container body, so that its position may be varied by simple swiveling.

Preferably the movable carrying handle is in the form of a U-shaped handle. Here it has expediently a holding bar which may be encompassed by the hand and joined at each end to a handle limb, while the two handle limbs are mounted movably and in particular pivotably on the container body.

It is advantageous if the movable carrying handle dips into the container body in the not-in-use position, at least partly and preferably entirely. In particular, in the not-in-use position, it comes to rest recessed in the top in such a way that it does not protrude above the container body. In this way, the top of the container body may be used for example without difficulty for the stable stacking on it of another container or other object.

Preferably, in the not-in-use position, the movable carrying handle dips into precisely the same recess, on the top of the container body, of which the side wall forms the engaging recess of the additional carrying handle. Consequently, one and the same recess may be assigned a dual function, while at the same time being easy to produce and not impairing the stability of the wall of the container body.

So that the movable carrying handle remains securely in the not-in-use position, even in the case of any vibration, when the container is being transported using the additional carrying handle, it is expedient to provide suitable securing means. Such securing means are in particular in the form of latching means which may be actuated with minimum application of force, in particular without additional handling and directly through the movement of the carrying handle relative to the container body on changing its position.

The container body expediently has a box- or bowl-shaped bottom part, which lies below when the first container alignment is adopted, and a lid assigned to the opening of the bottom part which here faces upwards. The lid may be positioned in either a closed position closing the opening, or in at least one open position raised from the bottom part. It is in particular mounted pivotably on the bottom part, to which it may be fixed in the closed position, in particular by locking means. The recess which contributes to forming the additional carrying handle is preferably at least partly and in particular wholly formed in the lid. The movable carrying handle is also preferably mounted on the lid.

In order to connect several stacked containers releasably to one another, the container may have suitable connecting means, with the engaging recess preferably forming an integral part of these connecting means.

Figure 2:
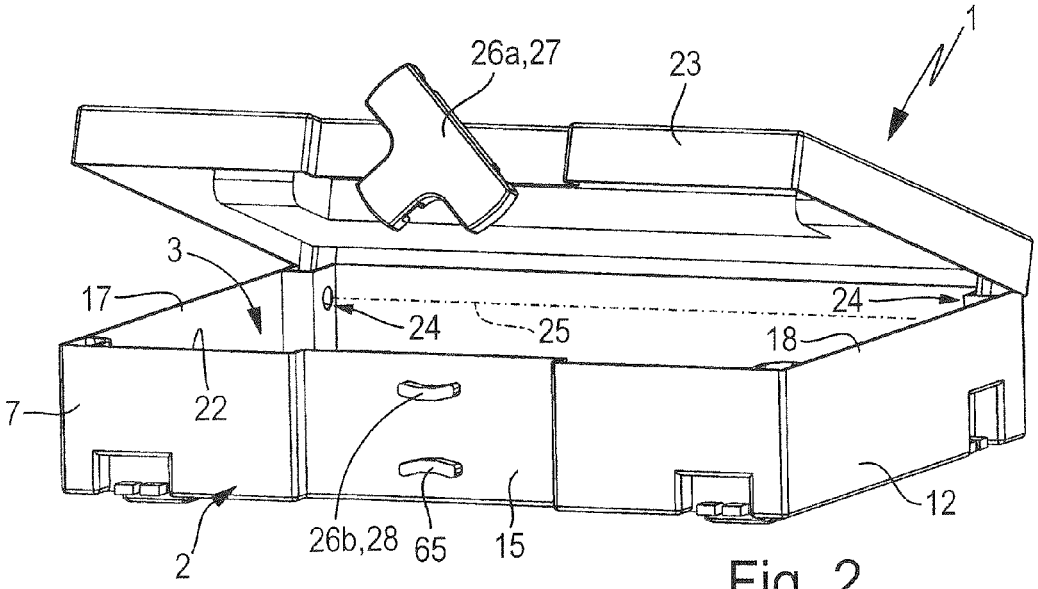
Figure 3:
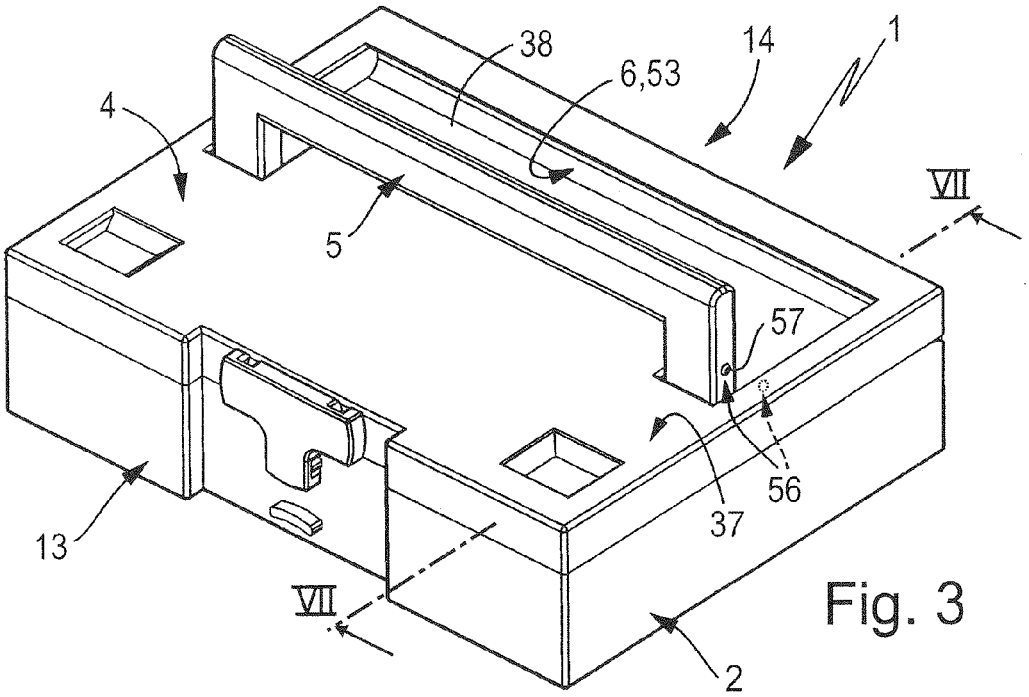
Figure 4:
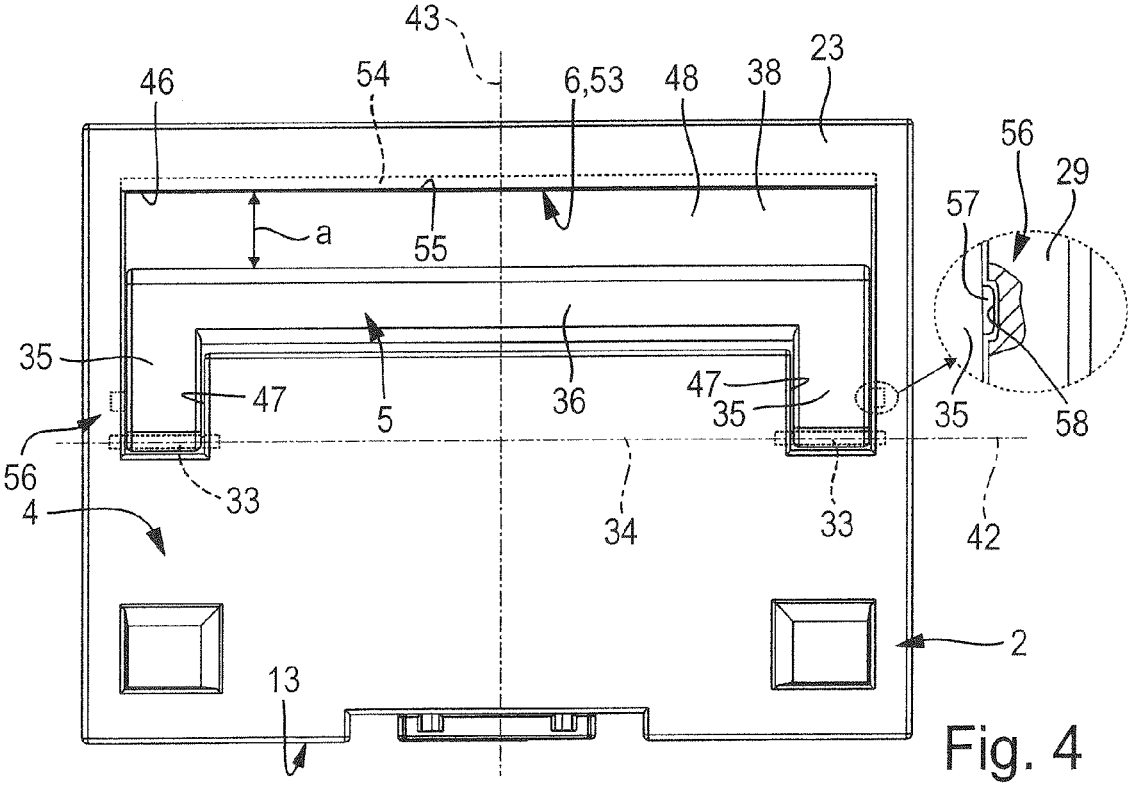

The invention is explained in detail below with the aid of the appended drawing, which shows in:

FIG. 1 a preferred design of the container according to the invention in a perspective view on adopting a first container alignment and with the movable carrying handle simultaneously moved into the not-in-use position FIG. 2 the container of FIG. 1 with its lid moved into an open position FIG. 3 the container of FIG. 1 with its movable carrying handle moved into the position of use FIG. 4 a plan view of the top of the container looking in the direction of arrow IV of FIG. 1

Figure 5:
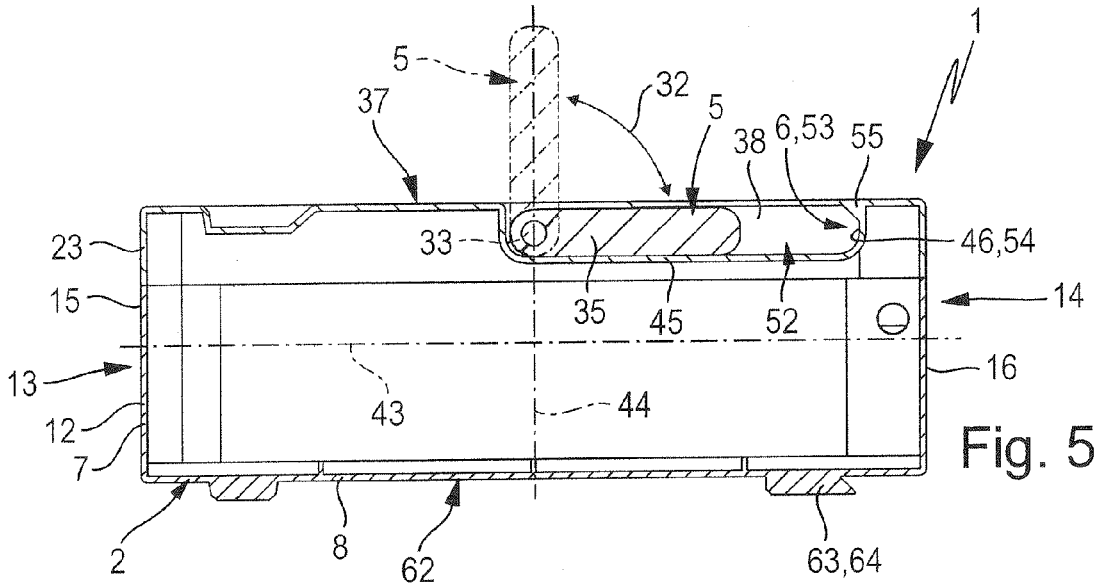
Figure 6:
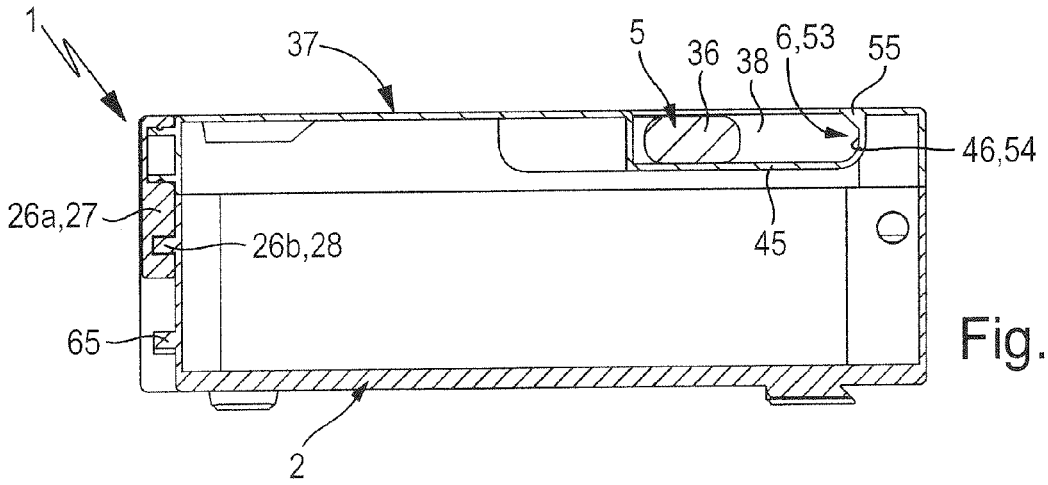

FIG. 5 a cross-section through the container of FIG. 1 along section line V-V, in which the movable carrying handle is indicated by dot-dash lines in adopting the position of use FIG. 6 a cross-section along section line VI-VI through the container of FIG. 1

Figure 7:
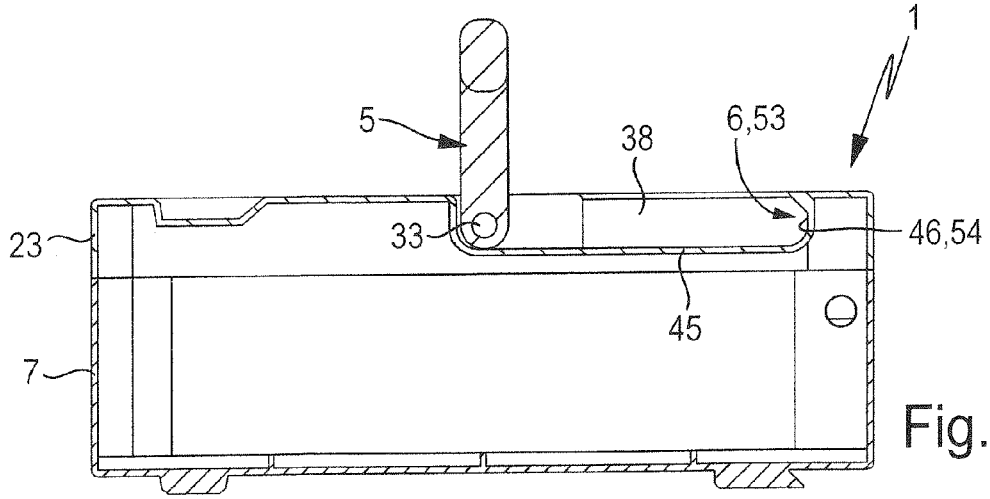

FIG. 7 a cross-section along section line VII-VII through the container of FIG. 3

Figure 8:
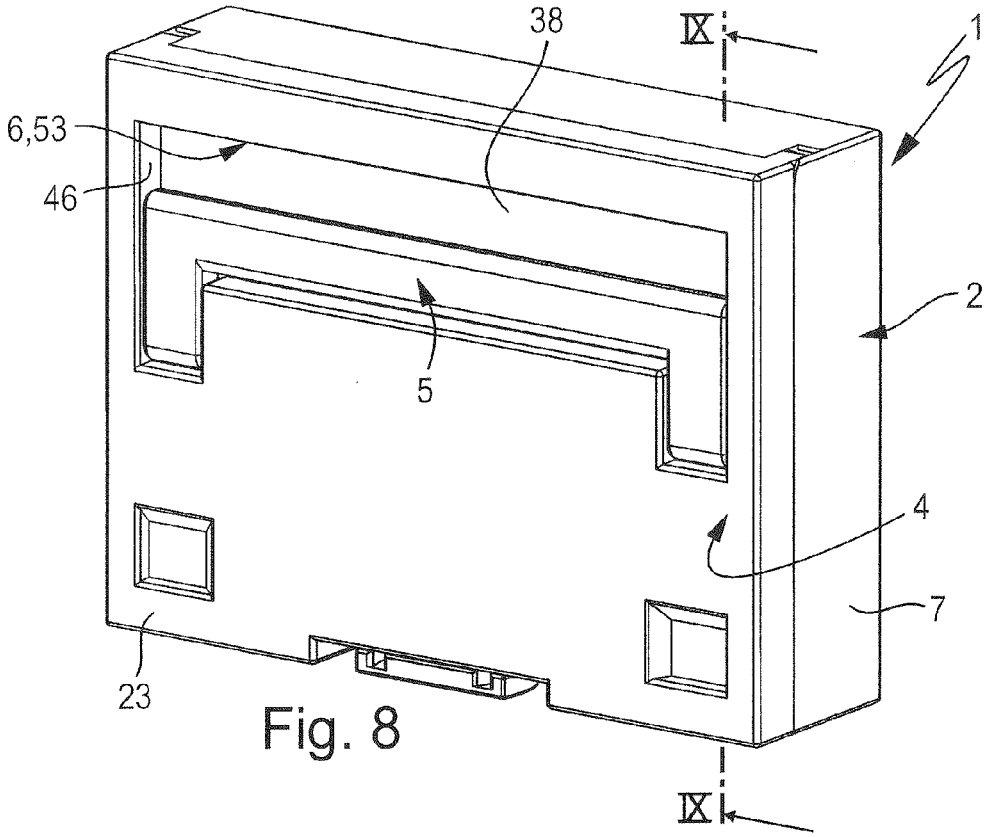
Figure 9:
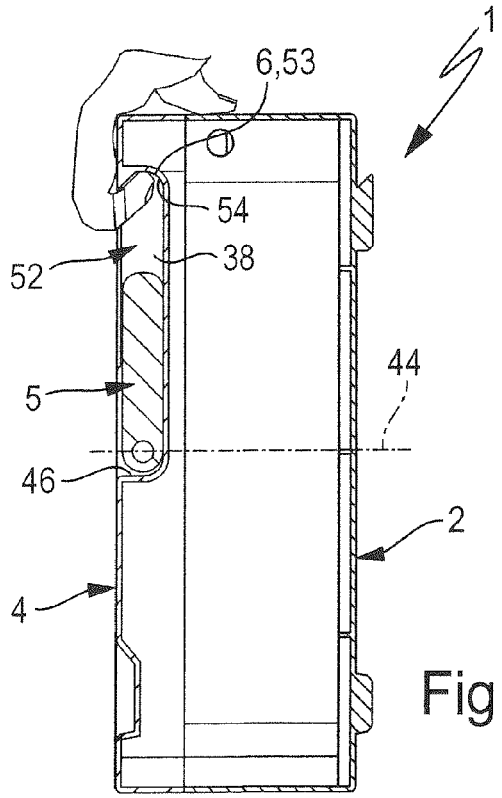

FIG. 8 a perspective view of the container on adopting its second container alignment, swivelled through 90° around a horizontal axis relative to FIG. 1, to use the additional carrying handle, and FIG. 9 a section through the container of FIG. 8 along section line IX-IX, with a human hand also indicated, gripping the additional carrying handle.

The container, altogether given the reference number 1, is suitable for the storage and transport of any desired objects, with a main area of use being that of storing machine power tools, in particular compressed air and/or electrical tools. The container 1 is designed so that it may be held and carried with one hand, for conveyance between different points.

The container 1 has a preferably cuboidal container body 2 bounding an interior space designated as storage space 3, which may be used to accommodate the objects referred to above. The container body 2 has a top 4 which faces vertically upwards when the container body 2 adopts its spatial alignment as shown in FIGS. 1 to 7, described below as the first container alignment.

Mounted on the container body 2 is a movable carrying handle 5, which may be held with one hand to transport the container 1 while retaining the first container alignment of the container body 2.

In addition, the container body 2 is also equipped with an immovable additional carrying handle 6, fitted rigidly on the container body 2 and independent of the movable carrying handle 5. This may be used to transport the container 1 with an upright alignment of the container body 2, i.e. when the container body 2 has the second container alignment shown by way of example in FIGS. 8 and 9, in which the top 4 faces to the side.

The container 1 may then be transported like a briefcase. The second container alignment may be obtained in particular by rotating or swiveling the container body 2, starting from the first container alignment, through 90° around a hypothetical horizontal axis.

The container body 2 is preferably made up of several parts. By way of example it has a box- or bowl-shaped bottom part 7, which lies below in the first container alignment, with a bottom surface 8 at the base, and a continuous frame-like side wall 12 extending upwards from the bottom surface 8. Preferably the side wall 12 is comprised of a front side wall section 15 assigned to a front 13 of the container body 2, and a rear side wall section 16 assigned to an opposite rear side 14 of the container body 2, together with two opposite side wall sections 17, 18.

The container body 2 also contains a lid 23 assigned to the opening 22 of the bottom part 7 facing upwards in the first container alignment. This too may be box- or bowl-shaped and may at any rate assume a closed position lying on the upper edge of the side wall 12 of the bottom part 7 and shown by way of example in FIGS. 1 and 5 to 7, in which it covers the opening 22, so that the storage space 3 is closed off from the surrounding area.

To make the storage space 3 accessible for loading and unloading, the lid 23 may be raised from the bottom part 7. A design is conceivable in which the lid 23 may be removed completely from the bottom part 7. Generally more expedient, though, is the variant realised by the embodiment, in which the lid 23 is mounted pivotably on the bottom part. The pivot bearing means 24, in particular in the form of hinges, provided for this purpose are located in particular in the area of the rear side 14, wherein they may be fitted at the side of the bottom part 7 on the rear side wall section 16 and/or on the two side wall sections 17, 18. The pivot bearing means 24 define a pivot axis 25, indicated by dot-dash lines in FIG. 2 and running horizontally when the first container alignment is adopted.

When the closed position is adopted, the lid 23 may be fixed immovably relative to the bottom part 7. Provided for this purpose are locking means 26*a*, 26*b* mounted on the container body 2 and located partly on the lid 23 and partly on the bottom part 7.

In the preferred embodiment, first locking means 26*a* fitted to the lid 23 are formed by a movable locking element 27 in particular in the form of a rotating locking bolt, and the locking means 26*b* fitted to the bottom part 7 comprise at least one rigid locking projection 28. On adoption of the closed position of the lid 23, the movable locking element 27 may be positioned either in a locking position evident from FIG. 1 or in a release position shown in FIG. 2. In the locking position it is in locking engagement with the locking projection 28, while in the release position this locking engagement is released, so that the lid 23 may be opened.

Expediently the locking means 26*a*, 26*b* are located on the front 13 of the container body 2.

While in the embodiment the locking means 26*a*, 26*b* are provided only once, and in particular in the longitudinal centre of the front 13, in principle several such locking means 26*a*, 26*b* could also be provided, spaced apart from one another.

The movable carrying handle 5 is preferably provided altogether on the top 4 of the container body 2. It is exemplarily mounted movably on the lid 23 in such a way that it can assume either a not-in-use position evident from FIGS. 1, 4 to 6, also 8 and 9, or a position of use apparent from FIGS. 3 and 7. The position changing movement which may be generated manually to change the position is indicated at 32 in FIG. 5 by a double arrow, and is preferably a swivel movement, since the movable carrying handle 5 is mounted pivotably on the container body 2. Preferably the mounting on the part of the container body 2 is exclusively on the lid 23, although it would be possible in principle to provide this mounting on the bottom part 7, in particular in conjunction with the movable carrying handle 5 overlapping the side of the lid 23.

In the embodiment, to realise the pivot mounting of the movable carrying handle 5, two bearing pins 33 are fixed in the lid 23, spaced apart and aligned coaxial to one another, and each passing through a section of the movable carrying handle 5.

The bearing pins 33 thus define together a pivot axis 34 for the lid 23, running horizontally on adoption of the first container alignment and indicated by dot-dash lines in FIG. 4.

Expediently, the movable carrying handle 5 is bow-shaped, with the form of a letter U. It has a holding bar 36, extending between two handle limbs 35 formed by U-limbs, and which may be gripped with one hand to carry the container 1. The two bearing pins 33 referred to above act on the free end sections of the two handle limbs 35. In the position of use according to FIGS. 3 and 7, the movable carrying handle 5 extends upwards over the top 4, while in the first container alignment the handle limbs 35 are oriented in particular vertically, and the holding bar 36 extends parallel to the plane of the lid with vertical clearance from the outer surface 37 on the top 4.

When swivelled into the not-in-use position, the movable carrying handle 5 is closer to the container body 2, being held expediently sunk in a recess 38 formed on the top 4 of the container body 2. Exemplarily, the recess 38 is an integral part of the lid 23, formed by a deepened contoured section of the lid 23.

Looking on to the top 4 of the container body 2, it expediently has a rectangular outline with a preferably elongated shape. An axis running centrally between and parallel to the front and rear side wall sections 15, 16 is described below as the longitudinal axis 42, and an axis running at right-angles to the former, centrally between the side wall sections 17, 18 is known as the transverse axis 43. In the first container alignment, a vertical axis 44 extends upwards at right-angles to both the longitudinal axis 42 and the transverse axis 43.

The movable carrying handle 5 is mounted on the lid 23 in particular so that its pivot axis 34 runs in the same vertical plane spanned by the longitudinal axis 42 and the vertical axis 44 as the longitudinal axis 42. This counteracts any tilting of the container body 2 when the container 1 is transported using the movable carrying handle 5.

The depth of the recess 38, measured in the axial direction of the vertical axis 44, is expediently such that the entire external contour of the movable carrying handle 5 dips into the recess 38 on adoption of the not-in-use position. According to FIGS. 5 and 6, the movable carrying handle 5 does not therefore protrude above the outer surface 37 of the lid 23 on the top 4. This facilitates stacking of the portable container 1 with others of its own kind.

As may be seen in particular in FIG. 4, the recess 38 is expediently U-shaped when viewed from above, looking on to the top 4. At the bottom it is bounded by a recess base 35 formed by an expediently one-piece element of the lid 23, and around the perimeter by a continuous side wall 46, described below as the recess side wall 46.

The recess 38, with its U-shaped contour when viewed from above, has two recess arms 47, spaced apart in the axial direction of the longitudinal axis 42, and a recess main section 48 extending between the two recess arms 47. The two handle limbs 35 dip with their free end sections into in each case one of the recess arms 47 and are supported therein by the bearing pins 33 or by other bearing means which define the pivot axis 34. If the movable carrying handle 5 is swivelled or folded up into the not-in-use position on the top 4, the handle limbs 35 lie within the recess arms 47 and the holding bar 36 is accommodated in the recess main section 48.

The width of the recess main section 48 measured in the axial direction of the transverse axis 43 is greater than that of the holding bar 36. Moreover the movable carrying handle 5 is so mounted and designed that, in adopting the not-in-use position, a preferably trough-like gap 52 of width "a" remains between the holding bar 36 and a length section 53 of the recess side wall 46 opposite the holding bar 36 in the axial direction of the transverse axis 43. This length section 53, which in particular has a linear extent and here runs preferably parallel to the longitudinal axis 42, forms the additional carrying handle 6 already referred to above. For this purpose, this length section 53 is provided with an engaging recess 54, preferably slot-like in shape and open towards the recess 38. The aforementioned length section 53 is thus shaped in particular in the manner of a concavity. It is possible for the fingers of one hand to reach into the engaging recess 54 thus formed, as illustrated in FIG. 9, in order to transport the container 1 in the second container alignment without using the movable carrying handle 5.

Because of the engaging recess 54, the additional carrying handle 6 has a relief-cut cross-section with a rib-like projection 55 at a distance from the recess base 35 in the axial direction of the vertical axis 44. On taking hold of the additional carrying handle 6, the fingertips grip this projection 55 from below, so that a positive grip is possible and accidental slippage of the human hand may be avoided.

The trough-like gap 52 ensures that the additional carrying handle 6 is easily accessible at any time, even when the movable carrying handle 5 is in the not-in-use position.

The length section 53 of the recess side wall 46 defining the additional carrying handle 6 is expediently arranged off-centre on the top 4, exemplarily therefore with lateral clearance from the longitudinal axis 42, while in particular extending into the vicinity of the rear side 14 and having a relatively small clearance from the rear side wall section 16. Here the engaging recess 54 faces towards the longitudinal axis 42, i.e. towards the front 13. Accordingly the additional carrying handle 6 assumes in the second container alignment a position relatively high up on the vertically oriented container body 2, thereby ensuring stable and therefore trouble-free carrying of the container 1.

In principle the additional carrying handle 6 could be formed alternatively or additionally by another length section of the recess side wall 46. In particular it would be conceivable to provide the additional carrying handle 6 on the top 4 in the vicinity of the front 13.

Use of the additional carrying handle 6 is made easier if it can be ensured that the movable carrying handle 5 remains securely in the not-in-use position during use of the additional carrying handle 6 and does not inadvertently automatically fold out into the position of use which may under certain circumstances cause an obstruction. In this connection the container 1 according to the example has special securing means 56, which effect a releasable fixing of the movable carrying handle 5 relative to the lid 23 in the not-in-use position.

These securing means 56 are in particular in the form of latching means, specifically and preferably so designed that they alone, by executing the position changing movement 32 of the movable carrying handle 5, automatically lock or release. This dispenses with the need for an additional locking or release operation, for example by actuating a locking element which is movable relative to the carrying handle.

Exemplarily the securing means 56 include two latch projections 57 fitted at different points to the movable carrying handle 5 and in particular moulded on integrally, and for each latch projection 57 a latch recess 58 fitted to the lid 23 in the swivel path of the assigned latch projection 57. By way of example, each latch projection 57 is fitted to one of the outer surfaces, oriented in the axial direction of the longitudinal axis 42, of one of the handle limbs 35, and the latch recess 58 is formed as a local depression in the recess side wall 46. Naturally the reverse may also apply, in that the latch recess 58 could be provided on the movable carrying handle 5 and the latch projection 57 could be fixed immovably to the container body 2.

Varying from the double pairing of latch projection 57 and latch recess 58 in the embodiment, it would also be possible for example to provide only one such pairing, which would then also be provided expediently in the area of one of the handle limbs 35.

The container 1 of the embodiment also opens up the advantageous option of stacking with other containers 1 of its kind. One container 1 is then placed with its underside 62 which faces downwards in the first container alignment on to the top 4 of another container. Since the additional carrying handle 6 is recessed in the top 4 of the container 1, it represents no impediment to such stacking, nor does the movable carrying handle 5 swivelled into the not-in-use position.

It is also advantageous if the container 1 is equipped with connecting means 63, which allow at least two containers 1 stacked on top of one another to be linked releasably to form a container unit. In an advantageous manner the additional carrying handle 6 is at the same time an integral part of these connecting means 63.

Specifically, the connecting means 63 in the embodiment comprise one or more engaging projections 64 located on the underside 62 of the container body 2 which, when the container 1 is placed on the top 4 of another container 1, engage positively in the engaging recess 54 of the additional carrying handle 6.

In addition, the movable locking element 27 also belongs to the connecting means 63, wherein by way of example it may be rotated into a connected position turned through 90° relative to the locking position of FIG. 1, so that it is simultaneously in engagement with the locking projection 28 located on the associated bottom part 7, and at the same time with a connecting projection 65 of the superimposed container 1 which is also located on the bottom part 7.

The engaging projections 64 located on the underside 62 may be used in the unconnected individually used state of the container 1 as feet for storing the container 1 in the first container alignment.

The invention claimed is:

1. A portable container with a container body and a movable carrying handle mounted pivotably on the container body about a pivot axis, wherein the container body has a top which faces upwards on adoption of a first container alignment and on which it is provided with a recess bounded by a side wall, and wherein the movable carrying handle may be positioned in either a position of use extending upwards above the container body, on adopting the first container alignment, or in a not-in-use position closer to the container body relative to the former position, and wherein a length section of the side wall of the recess forms an immovable additional carrying handle usable as an alternative to the movable carrying handle, and wherein it has an engaging recess open towards the recess and in which the fingers of a hand may engage from below, when the container body adopts a second container alignment with the top oriented sideways, and wherein the length section of the side wall of the recess forming the additional carrying handle and the engaging recess have a linear longitudinal extent extending parallel to the pivot axis of the movable carrying handle.

2. A container according to claim 1, wherein the length section of the side wall of the recess forming the additional carrying handle is arranged off-center on the top, wherein the engaging recess faces towards the center of the top.

3. A container according to claim 1, wherein the movable carrying handle is bow-shaped and has two handle limbs mounted movably on the container body and a holding bar which may be gripped with one hand, extending between the two handle limbs.

4. A container according to claim 1, wherein the movable carrying handle in the not-in-use position dips at least partly into the container body.

5. A container according to claim 4, wherein the movable carrying handle in the not-in-use position dips into the recess of the container body bounded at the side by the additional carrying handle, wherein there is provided between the movable carrying handle and the additional carrying handle a gap allowing grasping of the additional carrying handle when the carrying handle is moved into the not-in-use position.

6. A container according to claim 4, wherein the movable carrying handle in the not-in-use position dips entirely into the container body.

7. A container according to claim 1, wherein securing means are provided for releasable fixing of the movable carrying handle relative to the container body in the not-in-use position.

8. A container according to claim 7, wherein the securing means are in the form of latching means.

9. A container according to claim 8, wherein the securing means in the form of latching means have at least one latch projection provided on the movable carrying handle or on the container body, and a latch recess assigned to this latch projection on the other container component.

10. A container according to claim 8, wherein the securing means are in the form of latching means which are able to engage and release automatically on movement of the carrying handle.

11. A portable container with a container body and a movable carrying handle mounted on the container body, wherein the container body has a top which faces upwards on adoption of a first container alignment and on which it is provided with a recess bounded by a side wall, and wherein the movable carrying handle may be positioned in either a position of use extending upwards above the container body, on adopting the first container alignment, or in a not-in-use position closer to the container body relative to the former position, and wherein a length section of the side wall of the recess forms an immovable additional carrying handle usable as an alternative to the movable carrying handle, and wherein it has an engaging recess open towards the recess and in which the fingers of a hand may engage from below, when the container body adopts a second container alignment with the top oriented sideways, and wherein the movable carrying handle in the not-in-use position dips into the recess of the container body bounded at the side by the additional carrying handle, wherein there is provided between the movable carrying handle and the additional carrying handle a gap allowing grasping of the additional carrying handle when the carrying handle is moved into the not-in-use position, and wherein the movable carrying handle is bow-shaped and has two handle limbs mounted movably on the container body and a holding bar which may be gripped with one hand, extending between the two handle limbs, and wherein the length section of the side wall of the recess forming the additional carrying handle extends parallel to the holding bar of the movable carrying handle.

12. A portable container with a container body and a movable carrying handle mounted on the container body, wherein the container body has a top which faces upwards on adoption of a first container alignment and on which it is provided with a recess bounded by a side wall, and wherein the movable carrying handle may be positioned in either a position of use extending upwards above the container body, on adopting the first container alignment, or in a not-in-use position closer to the container body relative to the former position, and wherein a length section of the side wall of the recess forms an immovable additional carrying handle usable as an alternative to the movable carrying handle, and wherein it has an engaging recess open towards the recess and in which the fingers of a hand may engage from below, when the container body adopts a second container alignment with the top oriented sideways, and wherein the container body has a box- or bowl-shaped bottom part lying below in the first container alignment, and a lid assigned to the opening, here facing upwards, of the bottom part.

13. A container according to claim 12, wherein the recess provided on the top, and the additional carrying handle assigned to this recess are at least partly formed on the lid.

14. A container according to claim 13, wherein the recess provided on the top and the additional carrying handle assigned to this recess are entirely formed on the lid.

15. A container according to claim 12 wherein the lid is mounted pivotably on the bottom part for opening and closing.

16. A container according to claim 12, wherein the container body is provided with locking means for the releasable locking of the lid relative to the bottom part when it adopts a closed position closing the opening of the bottom part.

17. A container according to claim 12, wherein the length section of the side wall of the recess forming the additional carrying handle has a linear longitudinal extent.

18. A container according to claim 17, wherein the linear longitudinal extent of the length section of the side wall of the recess forming the additional carrying handle extends parallel to a rear or front side wall section of the container body.

19. A container according to claim 12, wherein the movable carrying handle is mounted pivotably on the container body in such a way that it may be moved between the position of use and the not-in-use position by swiveling relative to the container body.

20. A portable container with a container body and a movable carrying handle mounted on the container body, wherein the container body has a top which faces upwards on adoption of a first container alignment and on which it is provided with a recess bounded by a side wall, and wherein the movable carrying handle may be positioned in either a position of use extending upwards above the container body, on adopting the first container alignment, or in a not-in-use position closer to the container body relative to the former position, and wherein a length section of the side wall of the recess forms an immovable additional carrying handle usable as an alternative to the movable carrying handle, and wherein it has an engaging recess open towards the recess and in which the fingers of a hand may engage from below, when the container body adopts a second container alignment with the top oriented sideways, and wherein the container is equipped with connecting means for the reciprocal connection of two stacked containers.

21. A container according to claim 20, wherein the additional carrying handle forms an integral part of the connecting means.

* * * * *